US006436012B1

(12) United States Patent
Naville

(10) Patent No.: US 6,436,012 B1
(45) Date of Patent: Aug. 20, 2002

(54) SPORTING AND EXERCISING DEVICE HAVING A SPRING PORTION WITH STRINGED/CLIPPED SHOCK ABSORBERS

(75) Inventor: Denis Naville, Versoix (CH)

(73) Assignee: Christophe Ebersberg, VaduZ (LI)

( * ) Notice: Subject to any disclaimer, the term of this patent is extended or adjusted under 35 U.S.C. 154(b) by 0 days.

(21) Appl. No.: 09/196,411

(22) Filed: Nov. 19, 1998

(51) Int. Cl.[7] ..... A63B 25/10

(52) U.S. Cl. ..... 482/77; 482/79; 482/121; 36/7.8; 36/114

(58) Field of Search ..... 482/51, 74, 77, 482/79, 80, 121, 124, 126, 128; 36/7.8, 113, 114; 472/133, 135; 248/615, 621, 634; 403/279, 280, DIG. 14

(56) References Cited

U.S. PATENT DOCUMENTS

| | | | | |
|---|---|---|---|---|
| 1,638,350 A | | 8/1927 | Long | |
| 1,749,544 A | * | 3/1930 | Pagano | 482/126 |
| 1,877,218 A | * | 9/1932 | Blank | 482/126 |
| 3,219,358 A | | 11/1965 | Hagner | |
| 3,377,722 A | | 4/1968 | Downing | |
| 4,492,374 A | | 1/1985 | Lechtman et al. | |
| 4,534,124 A | | 8/1985 | Schnell | |
| 4,660,299 A | | 4/1987 | Omilusik | |
| 4,912,859 A | | 4/1990 | Ritts | |
| 5,007,607 A | * | 4/1991 | Kim | 248/615 |
| 5,205,798 A | | 4/1993 | Lekhtman | |
| 5,301,441 A | | 4/1994 | Kownacki | |
| 5,387,166 A | | 2/1995 | Gvoich | |
| 5,464,380 A | | 11/1995 | Ikeda et al. | |
| 5,511,324 A | | 4/1996 | Smith | |
| 5,643,148 A | | 7/1997 | Naville | |
| 5,758,860 A | * | 6/1998 | Hanazaki et al. | 248/634 |
| 5,871,298 A | * | 2/1999 | Lekhtman et al. | 482/77 |
| 5,916,071 A | * | 6/1999 | Lee | 482/77 |

FOREIGN PATENT DOCUMENTS

JP 3-195503 8/1991

* cited by examiner

*Primary Examiner*—Jerome W. Donnelly
*Assistant Examiner*—Victor K Hwang
(74) *Attorney, Agent, or Firm*—Darby & Darby

(57) ABSTRACT

The present invention relates to a sporting and exercising device comprising an upper foot-receiving portion and a lower spring portion. The spring portion comprises an upper spring layer arched upwardly, a lower spring layer arched downwardly, an intermediate, generally flat and substantially elastic elongate member, a first connecting member for interconnecting first ends of the intermediate member, upper spring layer and lower spring layer, and a second connecting member for interconnecting second ends of the intermediate member, upper spring layer and lower spring layer. The intermediate member has two longitudinally spaced apart openings each having a peripheral contour and a needle extending across the opening from the peripheral contour thereof. Resilient shock absorbing bodies each have an annular groove for receiving the peripheral contour of one of the openings and a hole which opens in the annular groove for receiving the corresponding needle. The intermediate member further comprises a central section formed of separate, laterally adjacent and substantially elastic strips which can be separately cut to adjust the resistance of the intermediate member to tension. The elastic strips can be replaced by metallic helical springs. An alternative is to combine elastic strips and helical springs; for example the central section can be formed of two lateral, substantially elastic strips and a central helical spring. Finally, the foot-receiving portion can be connected to the upper spring layer through a flexible fastening piece.

14 Claims, 6 Drawing Sheets

SPORTING AND EXERCISING DEVICE HAVING A SPRING PORTION WITH STRINGED/CLIPPED SHOCK ABSORBERS

BACKGROUND OF THE INVENTION

1. Field of the invention:

The present invention relates to a sporting and exercising device having an upper foot-receiving portion, and a lower spring portion including an upwardly arched upper spring layer, a downwardly arched lower spring layer, and an intermediate, generally flat and substantially elastic elongate member.

2. Brief description of the prior art:

U.S. Pat. No. 5,643,148 granted to Denis Naville on Jul. 1st, 1997 describes a sporting and exercising device comprising an upper foot-receiving portion and a lower spring portion. The spring portion consists of an upper spring layer arched upwardly, a lower spring layer arched downwardly, and an intermediate elastic plastic strap. A first end of the plastic strap is connected to both a first end of the upper spring layer and a first end of the lower spring layer, and a second end of the plastic strap is connected to both a second end of the upper spring layer and a second end of the lower spring layer. First and second resilient shock absorbing bodies are mounted longitudinally spaced apart from each other on the top face of the plastic strap. Similarly, third and fourth resilient shock absorbing bodies are mounted longitudinally spaced apart from each other on the bottom face of the plastic strap. The resilient shock absorbing bodies prevent the spring portion to collapse after a certain deformation by compression has been reached.

OBJECTS OF THE INVENTION

An object of the present invention is to provide an improved method for mounting shock absorbing bodies on an intermediate, generally flat and substantially elastic elongate member.

Another object of the present invention is to provide an intermediate, generally flat and substantially elastic elongate member having an adjustable resistance to tension.

SUMMARY OF THE INVENTION

More specifically, in accordance with the present invention, there is provided a method of mounting a resilient shock absorbing body on a generally flat member made of substantially elastic material. According to this method, an opening having a peripheral contour is made in the generally flat member, and a needle extending across the opening from the peripheral contour is formed in the substantially elastic material of the generally flat member. In the shock absorbing body are made an annular groove and a hole opening in the annular groove for receiving the needle. The needle is inserted in the hole of the shock absorbing body and, then, the annular groove of the shock absorbing body is positioned on the peripheral contour of the opening.

In accordance with preferred embodiments of the method of the invention:

- a first annular lip is formed on one side of the annular groove and a second annular lip on the other side of the annular groove of the shock absorbing body; and
- a first face of the generally flat member is recessed around the opening to receive the first annular lip, and a second face of the generally flat member is recessed around the opening to receive the second annular lip.

The present invention also relates to a generally flat member of substantially elastic material capable of receiving a resilient shock absorbing body formed with an annular groove and a hole which opens in the annular groove. The generally flat member comprises an opening having a peripheral contour for receiving the annular groove of the shock absorbing body, and a needle formed in the substantially elastic material of the generally flat member. This needle extends across the opening from the peripheral contour for insertion in the hole of the shock absorbing body.

The present invention is further concerned with a resilient shock absorbing body capable of being mounted on a generally flat and substantially elastic member formed with an opening having a peripheral contour and a needle extending across the opening from the peripheral contour of this opening. The resilient shock absorbing body comprises an annular groove to receive the peripheral contour of the opening, and a hole which opens in the annular groove for receiving the needle.

Still further in accordance with the invention, there is provided a sporting and exercising device comprising an upper foot-receiving portion, and a lower spring portion fastened to the foot-receiving portion and comprising (a) an upper spring layer arched upwardly and comprising first and second opposite ends, (b) a lower spring layer arched downwardly and comprising first and second opposite ends, (c) an intermediate, generally flat elongate member made of substantially elastic material and having first and second opposite ends, (d) a first connecting member for connecting the first end of the intermediate member to both the first ends of the upper and lower spring layers, and ( e) a second connecting member for connecting the second end of the intermediate member to both the second ends of the upper and lower spring layers. The improvement of the sporting and exercising device comprises:

- the intermediate member having first and second, longitudinally spaced apart openings each having a peripheral contour, a first needle made in the substantially elastic material and extending across the first opening from the peripheral contour of said first opening, and a second needle made in the substantially elastic material and extending across the second opening from the peripheral contour of the second opening;
- a first resilient shock absorbing body having a first annular groove for receiving the peripheral contour of the first opening, a first hole which opens in the first annular groove for receiving the first needle, a first protuberance extending toward the upper spring layer, and a second protuberance extending toward the lower spring layer; and
- a second resilient shock absorbing body having a second annular groove for receiving the peripheral contour of the second opening, a second hole which opens in the second annular groove for receiving the second needle, a third protuberance extending toward the upper spring layer, and a fourth protuberance extending toward the lower spring layer.

In accordance with preferred embodiments of this sporting and exercising device:

- the first needle extends from the peripheral contour of the first opening toward the first connecting member, and the second needle extends from the peripheral contour of the second opening toward the second connecting member;
- the first and second openings are adjacent to the first and second ends of the intermediate members, respectively;

the first opening is generally rectangular with rounded comers, the peripheral contour of the first opening comprises one side opposite to the first connecting member, and the first needle extends from the center of this side generally centrally of the first opening toward the first connecting member;

the second opening is generally rectangular with rounded comers, the peripheral contour of the second opening comprises one side opposite to the second connecting member, and the second needle extends from the center of this side of the peripheral contour of the second opening generally centrally of the second opening toward the second connecting member;

the intermediate member has a longitudinal axis and is lying into a first plane, each protuberance of the first and second shock absorbing bodies has a trapezoidal cross section in a second plane generally perpendicular to the longitudinal axis of the intermediate member, and a second generally semielliptical cross section in a third plane perpendicular to both the first and second planes; and the intermediate member comprises a central section made of at least one helical spring, and two spaced apart tongues interconnected by the helical spring(s), and wherein at least one of the two spaced apart tongues comprises a set of longitudinally spaced apart holes for hooking one end of each helical spring whereby the tension in the helical spring can be changed by changing the hole of the set to which the end of the helical spring is hooked.

According to the invention, there is provided a generally flat and substantially elastic elongate member comprising first and second opposite ends, and a central section formed of a combination of at least one helical spring and at least one substantially elastic strip. These at least one helical spring and at least one substantially elastic strip are laterally adjacent to each other. According to a preferred embodiment, the central section comprises two outer, lateral and generally elastic strips and a central helical spring.

Also in accordance with the subject invention, there is provided a generally flat and substantially elastic elongate member comprising first and second opposite ends and a central section formed of separate, laterally adjacent strips. At least one of these strips can be cut to adjust the resistance of the generally flat and substantially elastic member to tension.

According to a preferred embodiment, the central section comprises three separate, laterally adjacent strips including two outer strips and a central strip interposed between the two outer strips. Also, the central strip is narrower than, is wider than or has the same width as the outer strips.

An aspect of the present invention is concerned with a a sporting and exercising device comprising an upper foot-receiving portion, and a lower spring portion fastened to the foot-receiving portion and comprising ( a) an upper spring layer arched upwardly and comprising first and second opposite ends, ( b) a lower spring layer arched downwardly and comprising first and second opposite ends, ( c) an intermediate, generally flat and substantially elastic elongate member having first and second opposite ends, ( d) a first connecting member for connecting the first end of the intermediate member to both the first ends of the upper and lower spring layers, and ( e) a second connecting member for connecting the second end of the intermediate member to both the second ends of the upper and lower spring layers. According to the invention, the intermediate member has a central section formed of a combination of at least one helical spring and at least one substantially elastic strip, these at least one helical spring and at least one substantially elastic strip being laterally adjacent to each other.

Advantageously, the central section comprises two outer, lateral and generally elastic strips and a central helical spring.

The present invention still further relates to a sporting and exercising device comprising an upper foot-receiving portion, and a lower spring portion fastened to the foot-receiving portion and comprising ( a) an upper spring layer arched upwardly and comprising first and second opposite ends, ( b) a lower spring layer arched downwardly and comprising first and second opposite ends, ( c) an intermediate, generally flat and substantially elastic elongate member having first and second opposite ends, ( d) a first connecting member for connecting the first end of the intermediate member to both the first ends of the upper and lower spring layers, and ( e) a second connecting member for connecting the second end of the intermediate member to both the second ends of the upper and lower spring layers. The improvement in this sporting and exercising device comprises the intermediate member provided with a central section formed of separate, laterally adjacent strips which can be separately cut to adjust the resistance of the intermediate, generally flat and substantially elastic elongate member to tension in relation to the weight of a user of the sporting and exercising device.

Preferably:

the intermediate, generally flat and substantially elastic elongate member comprises first and second longitudinal edge surfaces, a first portion between the first opening and the first longitudinal edge surface, a second portion between the first opening and the second longitudinal edge surface, a third portion between the second opening and the first longitudinal edge surface, and a fourth portion between the second opening and the second longitudinal edge surface; and a first one of the two outer strips is aligned with the first and third portions and the second one of the two outer strips is aligned with the second and fourth portions to prevent any concentration of stresses in the intermediate member around the first and second openings.

The present invention still further relates to a sporting and exercising device comprising an upper foot-receiving portion, and a lower spring portion comprising ( a) an upper spring layer arched upwardly and comprising first and second opposite ends, (b) a lower spring layer arched downwardly and comprising first and second opposite ends, (c) an intermediate, substantially elastic elongate member having a first end connected to both the first end of the upper spring layer and the first end of the lower spring layer, and a second end connected to both the second end of the upper spring layer and the second end of the lower spring layer. According to the invention, this device comprises a flexible fastening piece for connecting the upper foot-receiving portion to the upper spring layer. The flexible fastening piece flexes to enable relative movement between the foot-receiving portion and the upper spring layer.

Preferably, ( a) the flexible fastening piece comprises first and second side plate members with first and second inner faces, respectively, ( b) the upper spring layer comprises first and second side edge faces, and ( c) the sporting and exercising device further comprises a mortise-and-tenon structure for mounting the flexible fastening piece to the upper spring layer, this mortise-and-tenon structure comprising:

a first groove on the first inner face, this first groove having an open end;

a second groove on the second inner face, this second groove having an open end;

a first tab protruding from the first side edge face; and a second tab protruding from the second side edge face; wherein the first and second tabs are slid in the first and second grooves for mounting the flexible fastening piece to the upper spring layer.

The objects, advantages and other features of the present invention will become more apparent upon reading of the following non restrictive description of a preferred embodiment thereof, given by way of example only with reference to the accompanying drawings.

DETAILED DESCRIPTION OF THE PREFERRED EMBODIMENT

Figure 1:
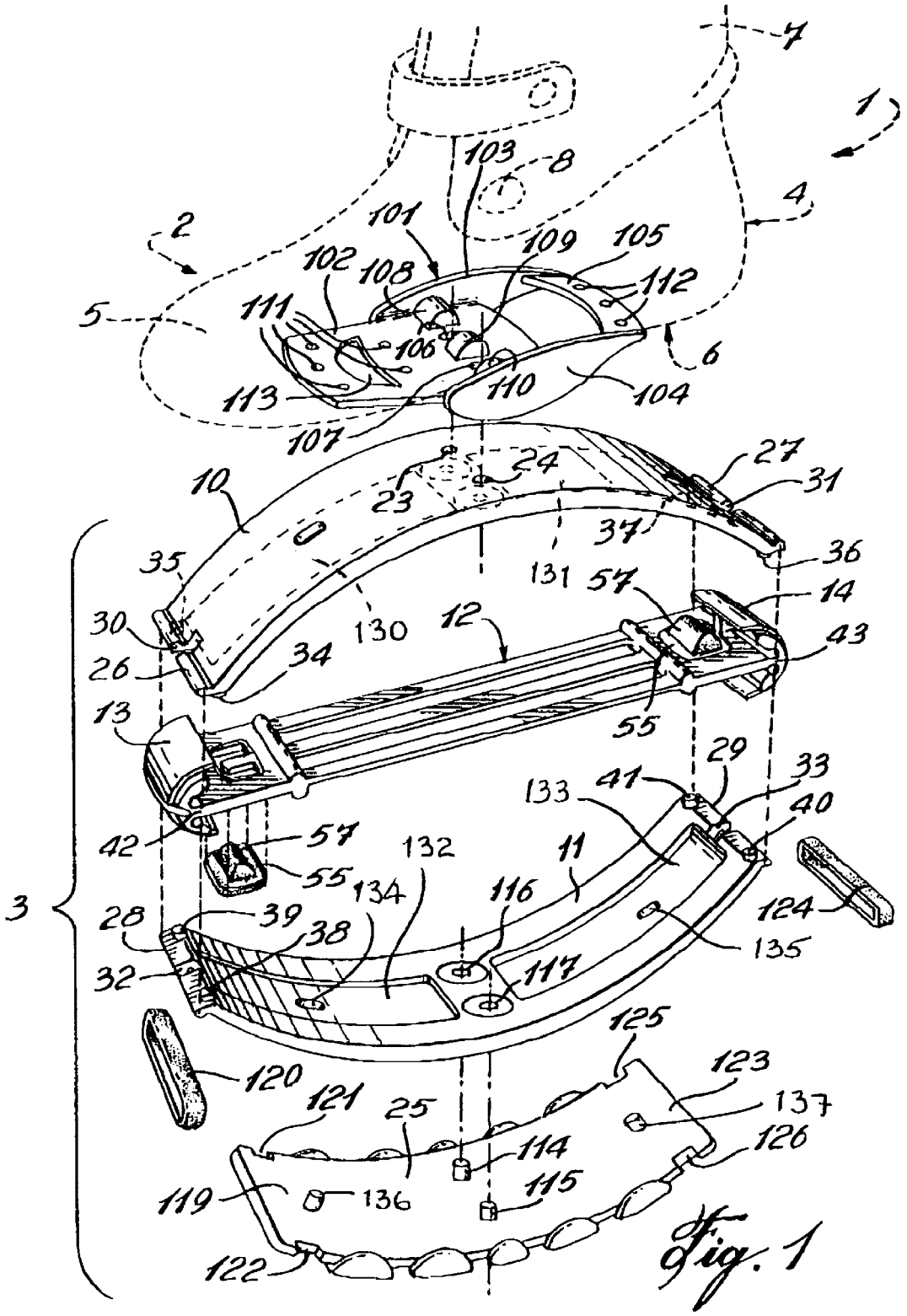
FIG. 1 is a perspective, exploded view of a sporting and exercising device according to the present invention, comprising an upper foot-receiving portion and a lower spring portion, the lower spring portion comprising an upper spring layer and a lower spring layer, and the upper spring layer being attached to the upper spring layer through a one piece flexible fastening piece.

FIG. 1 is a perspective, exploded view of a sporting and exercising device generally identified by the reference 1. The sporting and exercising device 1 comprises two major parts: an upper foot receiving portion 2 and a lower spring portion 3.

Preferably, the foot receiving portion 2 is formed of a boot 4. The boot 4 comprises a lower shell 5 with a bottom 6, and an upper shell 7 hingedly connected to the lower shell 5 through a pair of pivot fasteners of which one 8 is shown. The lower 5 and upper 7 shells are preferably made of molded plastic material. The boot 4 further includes a padded inner boot (not shown) inserted in the hingedly interconnected shells 5 and 7. This type of boot, currently used in the fabrication of ice skates, is well known to those of ordinary skill in the art and, accordingly, will not be further described.

It should be kept in mind that it is within the scope of the present invention to use in the sporting and exercising device 1 foot receiving portions having a structure different from that of the foot receiving portion 2 of FIG. 1.

The spring portion 3 comprises an upper spring layer 10, a lower spring layer 11, an intermediate spring rate and weight adjusting elongated plastic strap 12, and a sole 25.

As illustrated in FIG. 1, the upper spring layer 10 is arched upwardly and is made of a sturdy, generally flexible plastic material. The lower face of the spring layer 10 comprises hollows 130 and 131 both to save plastic material and to adjust the flexibility of the upper spring layer 10. The spring portion 3 is connected to the boot 4 through a one piece flexible fastening piece 101 preferably made of slightly flexible, molded plastic material. The flexible fastening piece 101 comprises:

a pair of vertical, generally oval-shaped side plate members 103 and 104;

a lower horizontal, generally trapezoidal front plate member 102; and a higher, transversal and curved flat bar member 105.

The flexible fastening piece 101 is detachably fastened to the upper spring layer 10 by means, for example, of a pair of screw-and-nut fasteners (not shown). The first screw-and-nut fastener is inserted through both a hole 23 in the upper spring layer 10 and a hole 106 in the plate member 102. The second screw fastener is inserted through both a hole 24 in the upper spring layer 10 and a hole 107 in the plate member 102. As can be seen in FIG. 1, holes 23 and 24 form a transversal series of two holes. In the same manner, holes 106 and 107 form a transversal series of two holes. Therefore, the plate member 102 is tangentially connected to the convex top face of the upwardly arched upper spring layer 10.

Figure 10:
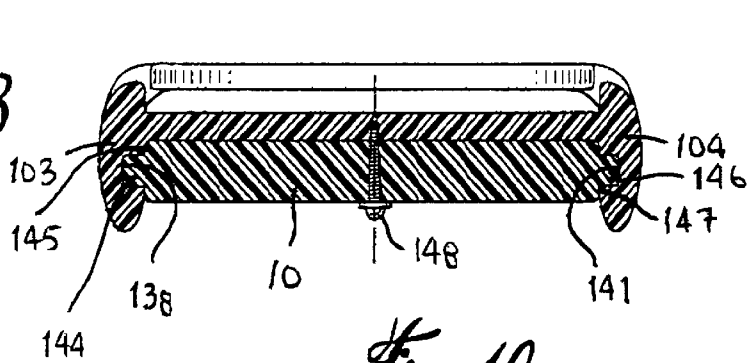
FIG. 10 is a cross sectional, end view showing the structure of FIGS. 8 and 9, for fastening the above mentioned one piece flexible fastening piece to the upper spring layer.
Figure 8:
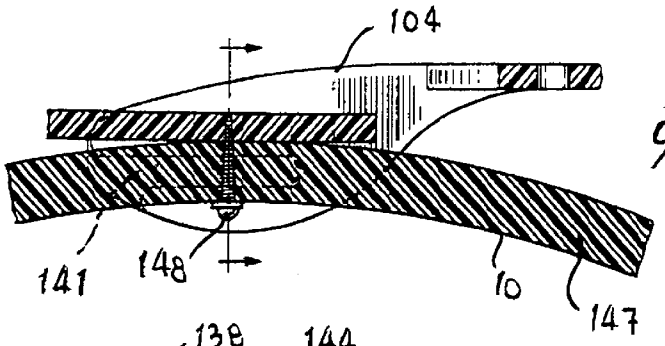
FIG. 8 is a side elevational, cross sectional view showing a structure for fastening the above mentioned one piece flexible fastening piece to the upper spring layer.
Figure 9:
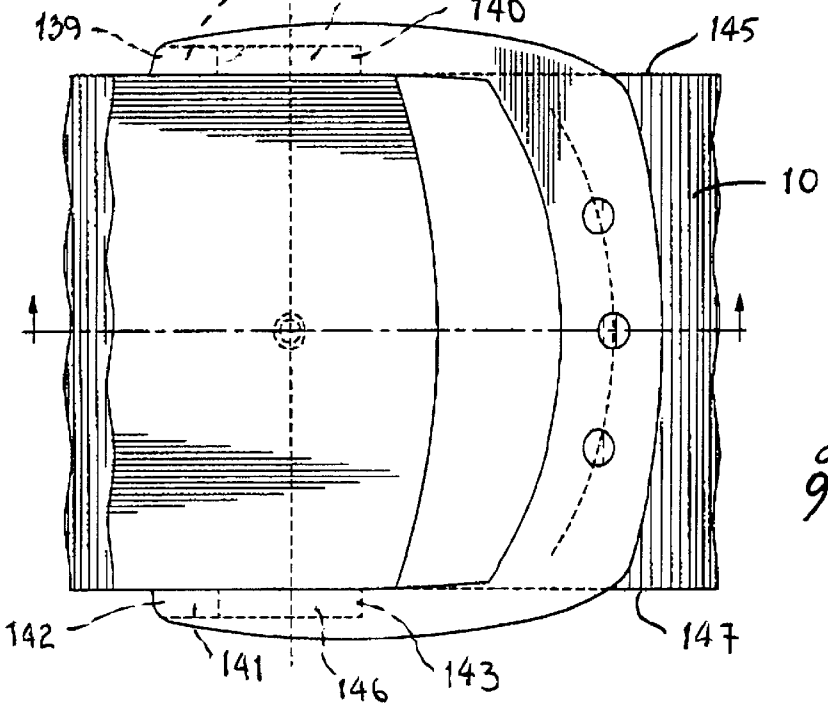
FIG. 9 is a cross sectional, top plan view showing the structure of FIG. 8, for fastening the above mentioned one piece flexible fastening piece to the upper spring layer.

Under certain conditions of operation, in particular when an adult uses the sporting and exercising device 1, the transversal series of two holes 23 and 24 may weaken sufficiently the upper spring layer 10 to cause rupture of this upper spring layer 10. Holes 116 and 117 will also weaken the lower spring layer 11. To eliminate the holes 23; 24 and 116; 117, a mortise-and-tenon structure as illustrated in FIGS. 8, 9 and 10 has been developed. Referring to FIGS. 8, 9 and 10, this mortiseand-tenon structure comprises:

on the generally oval-shaped side plate member 103, an inner, generally horizontal front-to-rear groove 138 open at the front end 139 and closed at the rear end 140;

on the generally oval-shaped side plate member 104, an inner, generally horizontal front-to-rear groove 141 open at the front end 142 and closed at the rear end 143;

a generally horizontal tab 144 protruding from the right side edge face 145 of the upper spring layer 10, tab 144 being slid into the open-ended inner groove 138 until it rests on the closed rear end 140;

a generally horizontal tab 146 protruding from the left side edge face 147 of the upper spring layer 10, tab 146 being slid into the open-ended inner groove 141 at the same time as tab 144 is slid into the open-ended inner groove 138 until the tabs 144 and 146 rest on the closed rear ends 140 and 143, respectively; and a screw 148 driven through both the upper spring layer 10 and the plate member 102 under protuberance 109 (described hereinafter) to prevent withdrawal of the tabs 144 and 146 from the grooves 138 and 141, respectively.

On the top face of the plate member 102 is provided a series of three coaxial generally semicylindrical protuberances 108, 109 and 110 which alternate with the holes 106 and 107. Protuberance 108 strengthens the connection between plate members 102 and 103, which are perpendicular to each other. In the same manner, protuberance 110 strengthens the connection between plate members 102 and 104, which are perpendicular to each other.

The bottom 6 of the lower shell 5 of the boot 4 is fastened to the plate member 102 for example by means of five rivets inserted in five hole 111 of the plate member 102, respectively, and through corresponding holes in the bottom 6. In the same manner, the bottom 6 of the lower shell 5 of the boot 4 is fastened to the bar member 105 for example by means of three rivets inserted in three holes 1 12 of the bar member 105, respectively, and corresponding holes in the bottom 6. Just a word to mention that the three protuberances 108–110 support the underside of the bottom 6 of the lower shell 5 of the boot 4.

The flexible fastening piece 101 brings about, amongst others, the following advantages:

Since the plate member 102 is tangentially connected to the top face of the upwardly arched upper spring layer 10, flexion of the slightly flexible plastic material of the flexible fastening piece 101 enables a certain pivotal movement of the boot 4 on the spring portion 3 about a generally transversal axis. A half-moon opening 113 of the plate member 102 promotes such flexion. This improves both comfort of the user and performance of the sporting and exercising device 1, by connecting the boot 4 to the spring portion 3 in a substantially flexible manner.

The side plate members 103 and 104 provides for lateral support of both the lower shell 5 of the boot 4, and the upper spring layer 10 of the spring portion 3.

Since the bottom 6 of the lower shell 5 of the boot 4 is connected to both the plate member 102 through five rivets, and the bar member 105 through three rivets, the stress imposed to the bottom 6 by the spring portion 3 is distributed over a large area of the bottom 6. Plastic material with a lower mechanical resistance can therefore be used to fabricate the lower 5 and upper 7 shells of the boot 4. Savings as important as 50% of the cost of the boot 4 can be made. Such savings are well higher than the additional cost for providing a flexible fastening piece 101.

The flexible fastening piece 101 enables better positioning of the boot 4 with respect to the spring portion. In the prior art, the boot 4 tilted rearwardly so that the users had to touch down on the ground with the front portion of the lower spring layer 11 and sole 25. That greatly reduced the performance of the sporting and exercising device since the optimal touchdown region is the center of the lower spring layer 11 and sole 25.

The flexible fastening piece 101 is designed for installing both left and right boots on respective spring portions 3, to thereby reduce the cost of the equipments required for manufacturing the sporting and exercising device.

The flexible fastening piece 101 creates a more aesthetic interconnection between the boot 4 and the spring portion 3, to make the design of the resulting sporting and exercising device more homogeneous.

Still referring to FIG. 1, the lower spring layer 11 is arched downwardly and is made of a sturdy, generally flexible plastic material. The upper face of the spring layer 11 comprises hollows 132 and 133 both to save plastic material and to adjust the flexibility of the lower spring layer 11. The lower spring layer 11 is further provided with a pair of laterally spaced apart and longitudinally centered holes 116 and 117. Finally, the lower spring layer 11 has a pair of longitudinally spaced apart and laterally centered oblong holes 134 and 135 respectively situated on opposite sides of the pair of holes 116 and 117.

A sole 25 is secured to the bottom face of the lower spring layer 11. For that purpose, the sole 25 comprises on its top concave surface two laterally spaced apart and longitudinally centered integral pins 114 and 115, and two longitudinally spaced apart and laterally centered integral pins 136 and 137. To install the sole 25 on the lower face of the lower spring layer 11, the following steps are conducted:

the integral pins 114, 115, 136 and 137 of the top concave surface of the sole 25 are respectively inserted in the holes 116,117, 134 and 135 of the lower spring layer 11, the oblong shape of the holes 134 and 135 making easier insertion of the pins 136 and 137 in the oblong holes 134 and 135, respectively;

a first end 119 of the sole 25 is fastened to the lower spring layer 11 by means of an elastic loop strap 120 encircling both the sole 25 and spring layer 11 and maintained in place by means of two rectangular side notches 121 and 122 of the sole 25, the sole 25 being slightly wider than the lower spring layer 11; and a second end 123 of the sole 25 is fastened to the lower spring layer 11 by means of an elastic loop strap 124 encircling both the sole 25 and the lower spring layer 11 and maintained in place by means of two rectangular side notches 125 and 126 of the sole 25.

The sole 25 further comprises an anti-slip bottom tread to prevent accidents caused by slipping of the device 1 on the ground.

The intermediate elongated plastic strap 12 is generally flat, is made of a substantially elastic plastic material, and is interposed between the upper and lower spring layers 10 and 11.

Figure 2:
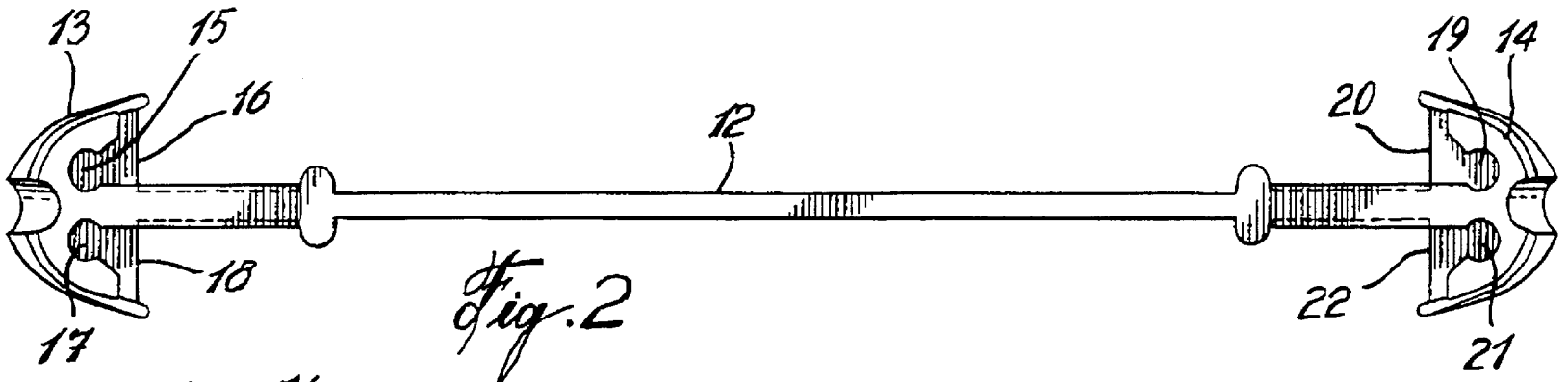
FIG. 2 is a side elevational view of an intermediate, generally flat and substantially elastic elongate member of the lower spring portion of the sporting and exercising device of FIG. 1.
Figure 3:
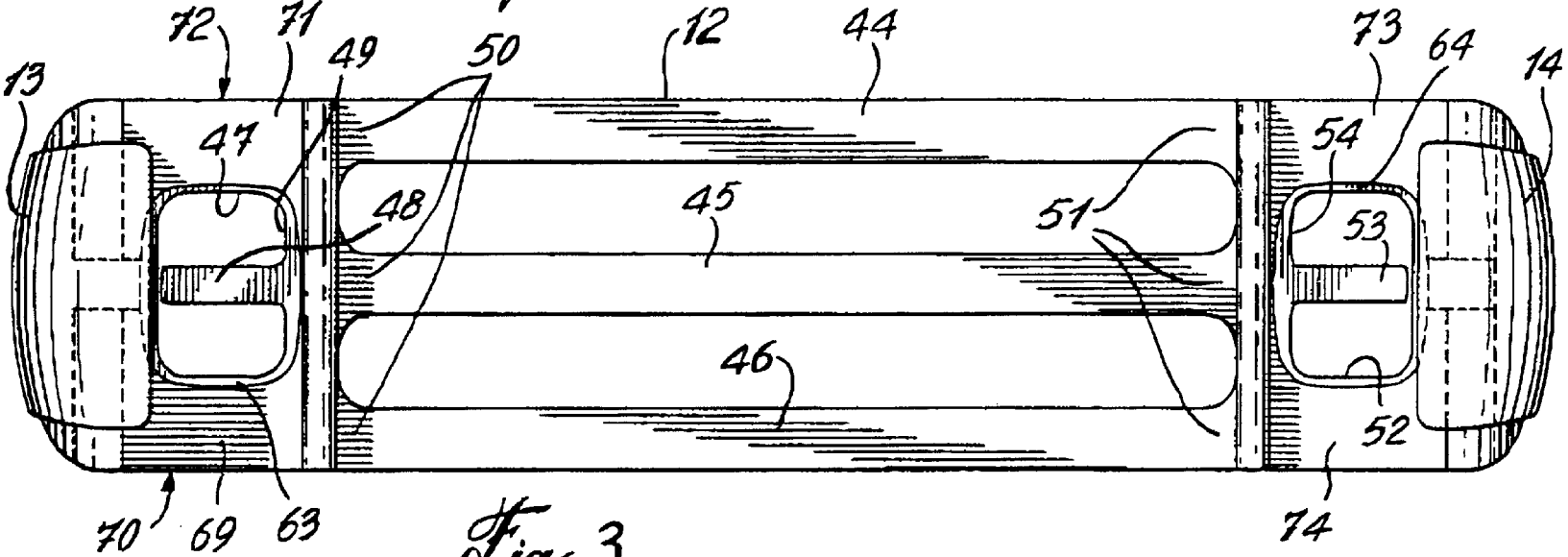
FIG. 3 is a top plan view of the intermediate, generally flat and substantially elastic elongate member of FIG. 2.

Referring to FIGS. 1–3, the intermediate elongated plastic strap 12 has a first end provided with a generally arrow-shaped integral connecting member 13, and a second end opposite to the first end and provided with a generally arrow-shaped integral connecting member 14. The arrow-shaped connecting member 13 comprises a transversal rear groove 15 on the top side of the plastic strap 12. As illustrated in FIGS. 1 and 2, groove 15 is separated into two groove sections by a central indent 16. The arrow-shaped connecting member 13 also comprises a transversal rear groove 17 on the bottom side of the plastic strap 12. Groove 17 is separated into two groove sections by a central indent 18 (FIG. 2).

The other arrow-shaped connecting member 14 comprises a transversal rear groove 19 on the top side of the plastic strap 12. As illustrated in FIG. 2, groove 19 is separated into two groove sections by a central indent 20. Similarly, the arrow-shaped connecting member 14 comprises a transversal rear groove 21 on the bottom side of the plastic strap 12. Still referring to FIG. 2, groove 21 is separated into two groove sections by a central indent 22.

To assemble the upper spring layer 10, the lower spring layer 11, and the intermediate plastic strap 12 together and thereby form the spring portion 3, the upper spring layer 10 is bent to insert its two opposite ends 26 and 27 into the grooves 15 and 19, respectively, and the lower spring layer 11 is also bent to insert its two opposite ends 28 and 29 into the grooves 17 and 21, respectively. The plastic strap 12 is then tensioned and stretched by the spring action produced by the resiliency of the arched upper and lower spring layers 10 and 11.

The end 26 of the upper spring layer 10 comprises a middle notch 30 fitted into the corresponding indent 16 of the groove 15. In the same manner, the end 27 of the upper spring layer 10 comprises a middle notch 31 fitted into the corresponding indent 20 of the groove 19. The end 28 of the lower spring layer 11 also comprises a middle notch 32 fitted into the corresponding indent 18 of the groove 17. Finally, the end 29 of the lower spring layer 11 comprises a middle notch 33 fitted into the corresponding indent 22 of the groove 21. When the spring portion 3 is assembled as described hereinabove, the arrow-shaped connecting member 13 connects one end of the plastic strap 12 with the ends 26 and 28 of the upper and lower spring layers 10 and 11, while the arrow-shaped connecting member 14 connects the other end of the plastic strap 12 with the ends 27 and 29 of the upper and lower spring layers 10 and 11.

The mutually mating indent and notch 16;30, 18;32, 20;31 and 22;33 will of course prevent lateral movement of the ends 26, 27,28 and 29 in the grooves 15,19,17 and 21, respectively, to thereby hold the ends 26, 27, 28 and 29 in the grooves 15, 19, 17 and 21, respectively.

Also, nipples 34 and 35 may extend from the bottom face of the upper spring layer 10 at the end 26 thereof, nipples 36 and 37 may extend from the bottom face of the upper spring layer 10 at the end 27 thereof, nipples 38 and 39 may extend from the top face of the lower spring layer 11 at the end 28 thereof, and nipples 40 and 41 may extend from the top face of the lower spring layer 11 at the end 29 thereof. When the spring portion 3 is assembled, the nipples 34–41 will abut respective edge surfaces such as 42 and 43 of the generally arrow-shaped connecting members 13 and 14 to help in holding the ends 26, 27, 28 and 29 in the grooves 15,19,17 and 21, respectively.

In operation, the nipples 34–41 abutting the respective edge surfaces such as 42 and 43 of the generally arrow-shaped connecting members 13 and 14, and the indents 16, 18, 20 and 22 inserted in the notches 30, 31, 32 and 33 will prevent lateral movement of the ends 26, 27, 28 and 29 in the grooves 15, 19, 17 and 21, respectively, when a small lateral force is applied. When a strong lateral force is applied, this strong force will overcome the restraint of the nipples 34–41 and will withdraw the indents 16, 20, 18 and 22 from the notches 30, 31, 32 and 33, respectively, to automatically disassemble the spring portion 3 and prevent the user to fall, and to twist and/or sprain his ankles. Upon disassembly of the spring portion 3, the user will step onto the bottom face of the upper spring layer 10.

As better shown in FIGS. 1 and 3, the central section of the intermediate elongated plastic strap 12 defines three separate, laterally adjacent strips 44, 45 and 46 of substantially elastic plastic material. The central strip 45 may be narrower than, be wider than, or have the same width as the two outer lateral strips 44 and 46. As an example, the strips 44"46 can be dimensioned so that:

the three strips 44–45 will enable operation of the sporting and exercising device 1 by a person whose weight is located between 90 and 120 kilograms;

with the central strip 45 cut, the two outer lateral strips 44 and 46 will enable operation of the sporting and exercising device 1 by a person whose weight is situated between 50 and 90 kilograms; and with the two outer lateral strips 44 and 46 cut, the central strip 45 will enable operation of the sporting and exercising device 1 by a young person whose weight is situated between 30 and 50 kilograms.

Therefore, the three-strip design of the intermediate elongated plastic strap 12 enables adjustment of the resistance of this strap to tension to three different ranges (levels) of users' weights. The advantage is that a single strap 12 is capable of accommodating the majority of the potential users.

Between a first end 50 of the three strips 44"46 and the arrow-shaped connecting member 13, the intermediate elongated plastic strap 12 comprises a transversally centered, generally rectangular opening 47 with rounded corners (see FIG. 3). Integral with the substantially elastic plastic material of the strap 12 is a needle 48 having a generally square cross section. Needle 48 extends axially in the plane of the generally rectangular opening 47 from the middle of a side 49 of opening 47 adjacent to the first end 50 of the three strips 44–46. More specifically, needle 48 extends axially in the plane of the generally rectangular opening 47 from the middle of side 49 toward the arrow-shaped connecting member 13.

Between a second end 51 of the three strips 44–46 and the arrow-shaped connecting member 14, the intermediate elongated plastic strap 12 comprises a transversally centered, generally rectangular opening 52 with rounded corners. As can be seen, opening 52 is longitudinally spaced apart from opening 47. Integral with the substantially elastic plastic material of the strap 12 is a needle 53 having a generally square cross section. Needle 53 extends axially in the plane of the generally rectangular opening 52 from the middle of a side 54 of opening 52 adjacent to the second end 51 of the three strips 44–46. More specifically, needle 53 extends axially in the plane of the generally rectangular opening 52 from the middle of side 54 toward the arrow-shaped connecting member 14.

Also, outer strip 44 is aligned with portion 71 of the plastic strap 12 situated between opening 47 and outer edge 72 and with portion 73 of the plastic strap 12 situated between the opening 52 and outer edge 72 to prevent any concentration of tensile stresses around the openings 47 and 52 which could cause tearing of the plastic material of the strap 12. In the same manner, outer strip 46 is aligned with portion 69 of the plastic strap 12 situated between opening 47 and outer edge 70 and with portion 74 of the plastic strap 12 situated between opening 52 and outer edge 70 to prevent any concentration of tensile stresses around the openings 47 and 52 which could cause tearing of the plastic material of the strap 12.

Figure 4A:
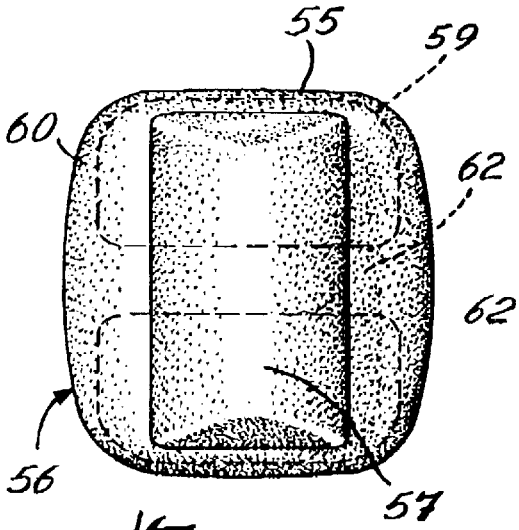
FIG. 4*a* is a top plan view of a resilient shock absorbing body structured to be mounted in an opening of the intermediate, generally flat and substantially elastic elongate member of FIGS. 2 and 3.
Figure 4B:
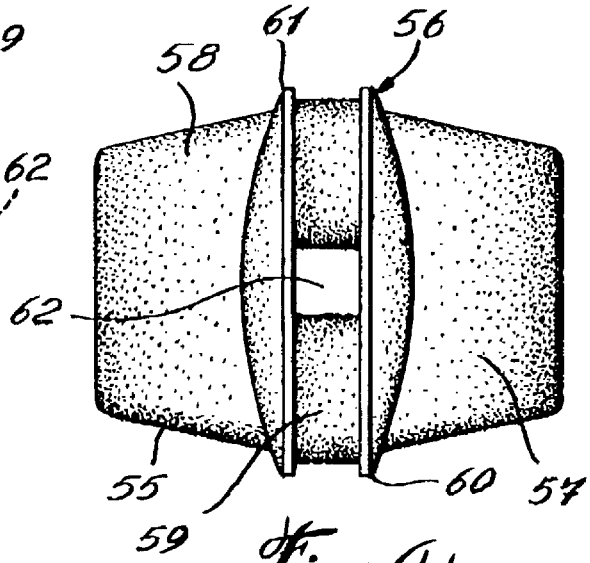
FIG. 4*b* is a side elevational view of the resilient shock absorbing body of FIG. 4*a;*
Figure 4C:
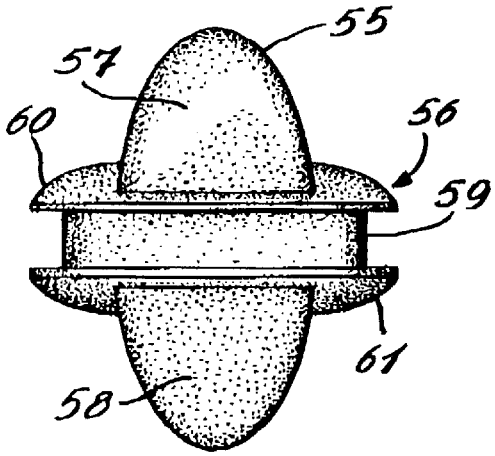
FIG. 4*c* is an end elevational view of the resilient shock absorbing body of FIGS. 4*a* and 4*b;*

The function of the needle 48 and the generally rectangular opening 47 is to receive a resilient shock absorbing body 55 as illustrated in FIGS. 4*a*, 4*b* and 4*c*. Shock absorbing body 55 is a one piece solid body made of resilient material such as rubber, plastic, foam, etc.

The preferred embodiment of the shock absorbing body 55 shown in FIGS. 4*a*, 4*b* and 4*c* has a central, generally flat portion 56, and a pair of elongated and tapering symmetrical protuberances 57 and 58 respectively situated on the opposite faces of the central, generally flat portion 56. FIG. 4*b* shows that each protuberance 57, 58 has a trapezoidal longitudinal cross section. FIG. 4*c* shows that each protuberance 57, 58 has a generally semielliptical transversal cross section. Of course, it is within the scope of the present invention to give other shapes to the protuberances 57 and 58.

The central, generally flat portion 56 defines an annular groove 59 generally defining the same rectangular contour as the opening 47. On both side of the annular groove 59, the central, generally flat portion 56 defines respective annular lips 60 and 61.

Finally, a hole 62 passes through the shock absorbing body 55. Hole 62 extends centrally of the body 55 from the bottom of the annular groove 59 on one side of the body 55 to the bottom of the groove on the opposite side of the body 55. Accordingly, hole 62 opens into the annular groove 59. As can be seen in FIG. 4*a*, the hole 62 is straight and perpendicular to the elongated protuberances 57 and 58. Also, the hole 62 has a square cross section. The cross sectional dimensions of the hole 62 are substantially the same as the cross sectional dimensions of the needle 58.

To install a shock absorbing body 55 in the opening 47, the following steps are performed:

- the needle 48 is bent out of the opening 47 on either side of the plastic strap 12;
- the shock absorbing body 55 is then stringed on the needle 48 by inserting the needle 48 into the hole 62; and
- the shock absorbing body 55 is then clipped into the hole 47 by forcing
- the shock absorbing body 55 into the hole 47 until the annular groove 59 is located on the contour of the opening 47.

It should be mentioned here that the material of the intermediate plastic strap 12 is recessed around the opening 47 (see 63 in FIG. 3) on both sides of the strap 12 to receive the lips 60 and 61, respectively. Since the width of the annular groove 59 is equal to the width of the square hole 62, the area 63 around the opening 47 must have a thickness equal to the thickness of the needle 48 to receive the groove 59 and lips 60 and 61 of the shock absorbing body 55.

As shown in FIG. 1, the protuberances 57 and 58 then extend transversally of the elongated intermediate plastic strap 12. More specifically, protuberance 57 is located on the upper side of the strap 12 and extends toward the upper spring layer 10, while protuberance 58 is located on the lower side of the strap 12 and extends toward the lower spring layer 11.

Similarly, to install a shock absorbing body 55 in the opening 52, the following procedure is followed:

- the needle 53 is bent out of the opening 52 on either side of the plastic strap 12;
- the shock absorbing body 55 is then stringed on the needle 53 by inserting the needle 53 into the hole 62; and
- the shock absorbing body 55 is then clipped into the hole 52 by forcing
- the shock absorbing body 55 into the hole 52 until the annular groove 59 is located on the contour of the opening 52.

Again, the material of the intermediate plastic strap 12 is recessed around the opening 47 on both side of the strap 12 (see 64 in FIG. 3) to receive the lips 60 and 61. Since the width of the annular groove 59 is equal to the width of the square hole 62, the area 64 around the opening 52 must have a thickness equal to the thickness of the needle 53 to receive the groove 59 and lips 60 and 61 of the shock absorbing body 55.

Again, as illustrated in FIG. 1, the protuberances 57 and 58 extend transversally of the elongated intermediate plastic strap 12. More specifically, protuberance 57 is located on the upper side of the strap 12 and extends toward the upper spring layer 10, while protuberance 58 is located on the lower side of the strap 12 and extends toward the lower spring layer 11.

To remove a shock absorbing body 55 from the opening 47 or 52, the following procedure is followed:

- the annular groove 59 is removed from the contour of the opening 47, 52; and
- the needle 48, 53 is removed from the opening 52.

Figure 6:
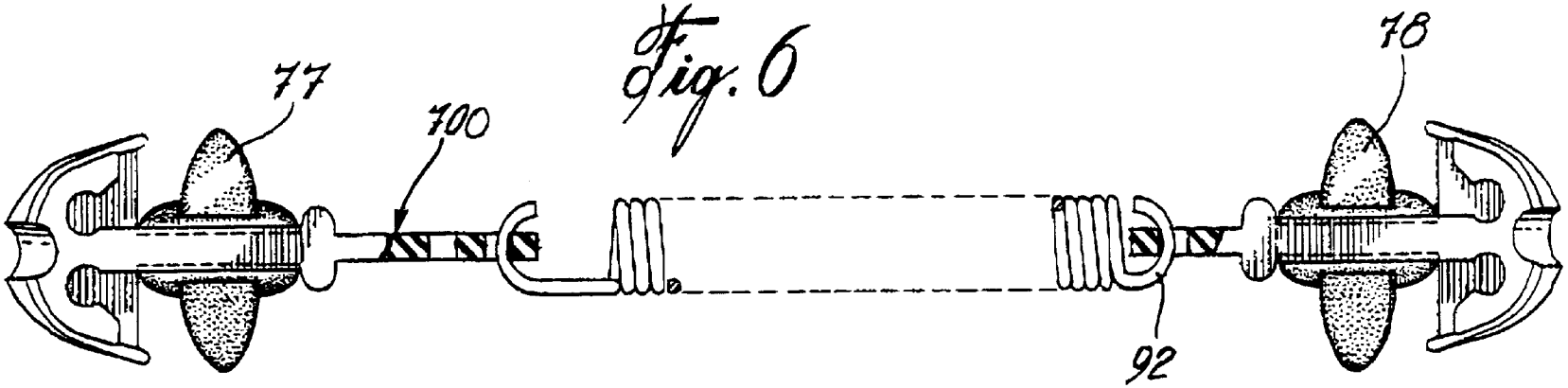
FIG. 6 is a side elevational view of another embodiment for the intermediate elastic elongate member of the lower spring portion of the sporting and exercising device according to the invention.
Figure 7:
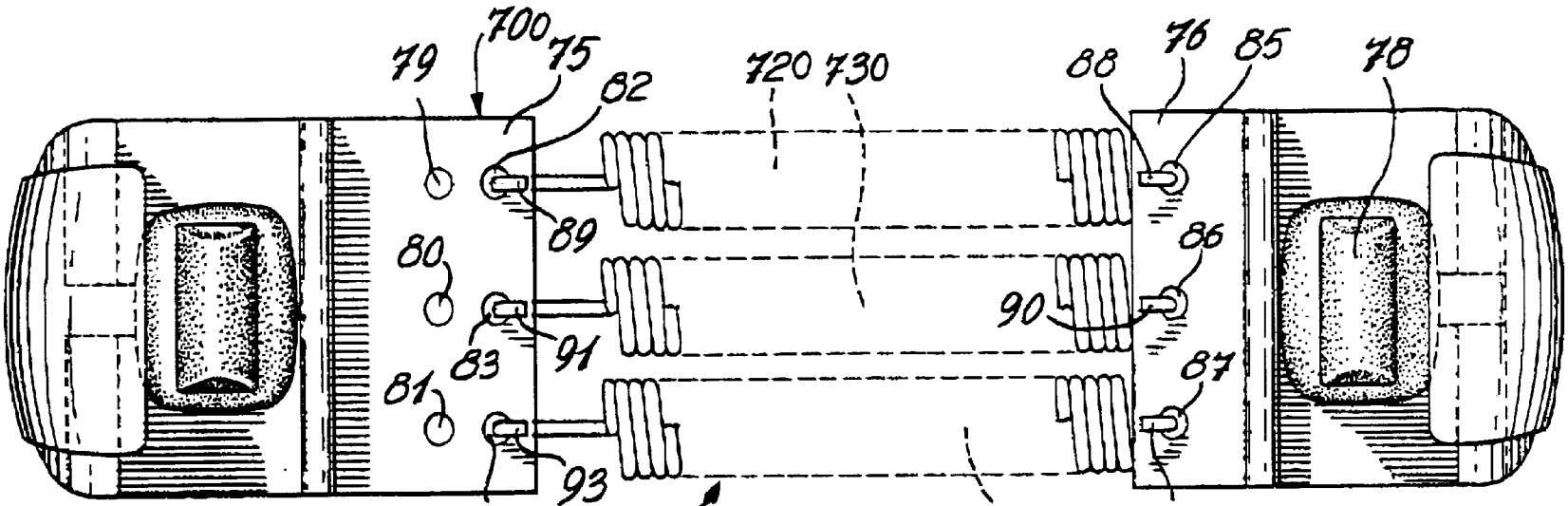
FIG. 7 is a top plan view of the intermediate elastic elongate member of FIG. 6.

FIGS. 6 and 7 illustrate another embodiment of the intermediate, elastic elongated member of the spring portion 3 of the sporting and exercising device 1. This intermediate, elastic elongated member 700 comprises a central section 710 including three helical springs 720,730 and 740 and two tongues 75 and 76.

Tongue 75 extends the full width of the intermediate, elastic elongated member 700 from shock absorbing body 77. Tongue 75 has a free end formed with a first transversal series of holes 79, 80 and 81, and a second adjacent transversal series of holes 83, 83 and 84.

In the same manner, tongue 76 extends the full width of the intermediate, elastic elongated member 700 from shock absorbing body 78. Tongue 76 has transversal series of holes 85, 86 and 87.

Helical spring 720 has a first end 88 hooked in hole 85 and a second end 89 that can be hooked either in hole 79 or 82; hooking end 89 in hole 82 will reduce the tension while hooking end 89 in hole 79 will increase the tension. Helical spring 730 has a first end 90 hooked in hole 86 and a second end 91 that can be hooked either in hole 80 or 83; hooking end 91 in hole 83 will reduce the tension while hooking end 91 in hole 80 will increase the tension. Helical spring 740 has a first end 92 hooked in hole 87 and a second end 93 that can be hooked either in hole 81 or 84; hooking end 93 in hole 84 will reduce the tension while hooking end 93 in hole 81 will increase the tension.

The resistance to tension provided by the helical springs can be adjusted as follows:

- use of the three springs 720, 730 and 740 to obtain the highest resistance to tension; the ends 89, 91 and 93 of the springs 720, 730 and 740 can be positioned in the holes 82–84 of the tongue 75 to obtain a lower tension or in the holes 79–81 of the tongue 75 to obtain a higher tension in the springs 720, 730 and 740.
- use of the two outer helical springs 720 and 740 to obtain an intermediate resistance to tension; the end 89 and 93 of the springs 720 and 740 can be positioned in the holes 82 and 84 of the tongue 75 to obtain a lower tension or in the holes 79 and 81 of the tongue 75 to obtain a higher tension in the helical springs 720 and 740 and
- use of the single central helical spring 730 obtain the lowest resistance to tension; the end 91 of the helical spring 730 can be positioned in the hole 83 of the tongue 75 to obtain a lower tension or in the hole 80 of the tongue 75 to obtain a higher tension.

To further adjust the tension, stronger or weaker springs 720, 730 and 740 can be used. Also, the different springs 720, 730 and 740 can present different resistances to tension.

It is further within the scope of the present invention to combine, in the central section of the intermediate elongated plastic strap 12, strips of substantially elastic plastic material and metallic helical springs. For example, the central section of the intermediate elongated plastic strap 12 will possibly comprise the two outer lateral strips 44 and 46 (FIG. 3) combined with the central helical spring 730 (FIG. 7).

Figure 5:
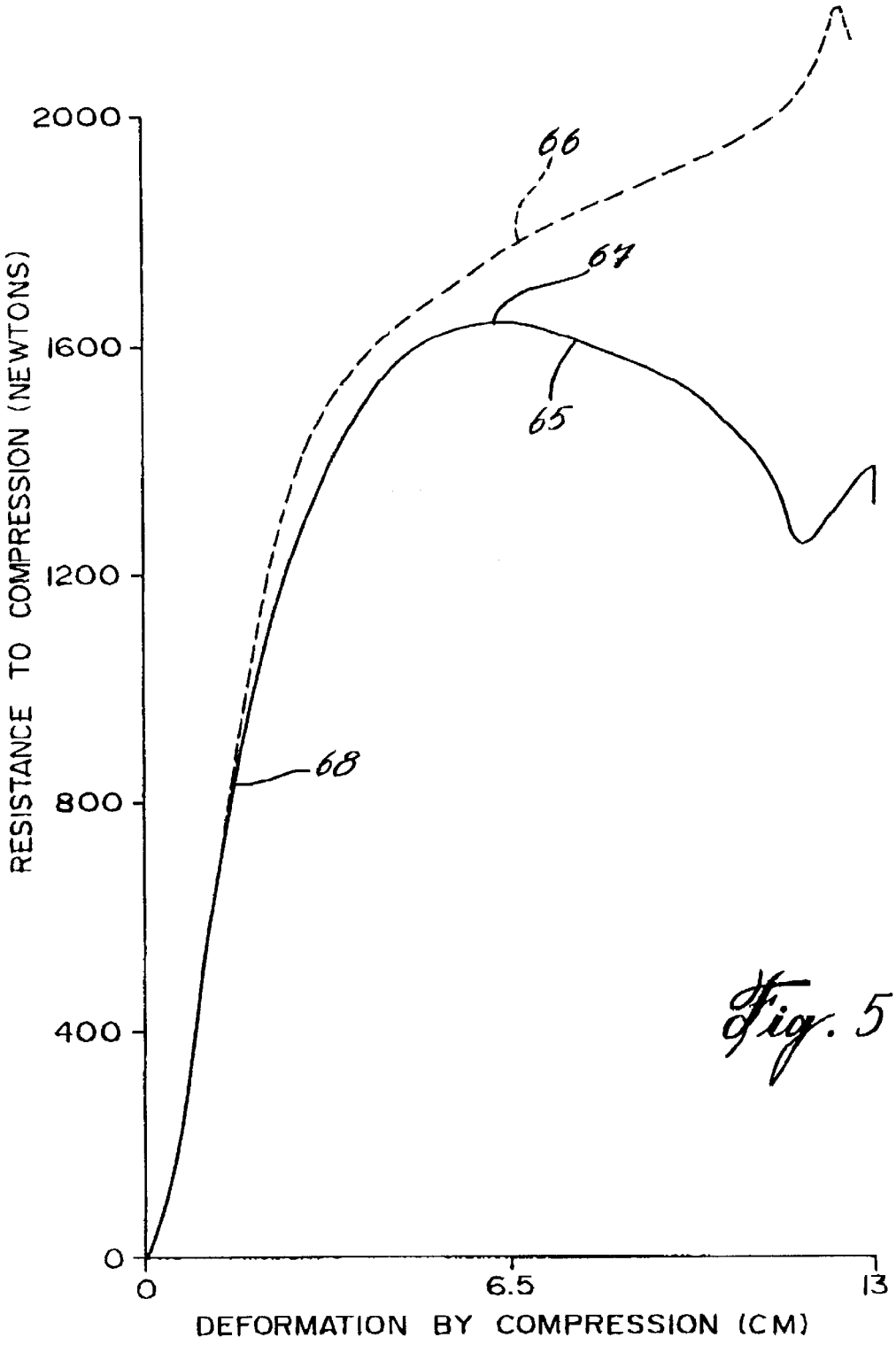
FIG. 5 is a graph illustrating the evolution of the resistance of the spring portion to compression as a function of the deformation by compression of ( a) a prior art sporting and exercising device provided with no shock absorbing bodies (curve 65), and ( b) a sporting and exercising device according to the present invention (curve 66)

FIG. 5 is a graph illustrating the evolution of the resistance of the spring portion 3 to compression as a function of the deformation of this spring portion 3 by compression.

More specifically, curve 65 of FIG. 5 illustrates an example of evolution of the resistance of the spring portion 3 to compression as a function of deformation of this spring portion 3 by compression, for a prior art plastic strap comprising no shock absorbing bodies 55. As can be seen, the maximal resistance to compression of the spring portion 3 is found at point 67 of curve 65. From this point, the resistance of the spring portion 3 gradually reduces as the deformation by compression increases.

As the spring portion 3 collapses at point 67, this spring portion 3 lacks smooth, growing elasticity. This reduces the ability of the sporting and exercising device 1 to absorb increasing higher pressures. This also reduces the available bouncing power and makes the sporting and exercising device noisy.

To overcome this drawback, shock absorbing bodies 55 are mounted on the plastic strap 12 as described in the foregoing description. When the deformation by compression of the spring portion 3 reaches point 68, the bottom face of the upper spring layer 10 applies to the protuberances 57 of the shock absorbing bodies 55, while the top face of the lower spring layer 11 applies to the protuberances 58 of the shock absorbing bodies 55. At this moment:

(a) the resilient shock absorbing bodies 55 progressively absorb compression forces and corresponding energy is accumulated and stored in the resilient bodies 55 and is subsequently released to increase the bouncing power of the sporting and exercising device 1;

(b) each shock absorbing body 55 creates a progressively increasing lever force on the respective end sections of the spring layers 10 and 11 between the shock absorbing body 55 and the corresponding arrow-shaped connecting member 13 or 14 whereby the flexibility of these end sections contribute to increase the resistance to compression of the spring portion 3; and (c) starting from a certain degree of compression of the shock absorbing bodies 55, the span of the two spring layers 10 and 11 is reduced to the distance separating the two shock absorbing bodies 55 whereby the rigidity of the spring layers 10 and 11 increases to increase the resistance to compression of these spring layers.

The above described structure including the shock absorbing bodies 55 presents, amongst others, the following advantages:

increased bouncing power of the device;

improved comfort for the user;

increased flexibility of the sporting and exercising device (wider range of resistance to compression);

improved protection of the user's joints by a better absorption of the impacts and by an increased impact time;

the sporting and exercising device is more quiet whereby it can also be used indoors, for example in fitness classes;

stringing and clipping of the shock absorbing bodies enable more personalized weight and stiffness/softness adjustments of the sporting and exercising device for each user by simply changing the shock absorbing bodies with other shock absorbing bodies of different dimensions and hardness to improve comfort and the bouncing power;

stringing and clipping of the shock absorbing bodies is an inexpensive method for installing the shock absorbing bodies on the intermediate plastic strap;

upon replacing the plastic strap, stringing and clipping of the shock absorbing bodies enables removal of the shock absorbing bodies from the old strap and installation thereof on the new plastic strap whereby the cost of replacing the plastic strap is reduced by approximately 40% since the same shock absorbing bodies are re-used;

the three strips 44–46 enable adjustment of the resistance of the plastic strap to tension to three different levels to accommodate most of the potential users; and as indicated in the foregoing description, alignment of the outer strip 44 with portions 71 and 73 and alignment of the outer strip 46 with portions 69 and portion 74 prevent any concentration of tensile stresses around the openings 47 and 52 which could cause tearing of the plastic material of the strap 12.

Finally, curve 66 of FIG. 5 shows that the resistance of the spring portion 3 to compression continues to increase after the threshold (point 67) of deformation by compression has been reached. Generally speaking, the present invention eliminates the major drawback of a spring portion that collapses as soon as a given deformation by compression has been reached.

Although the present invention has been described hereinabove by way of a preferred embodiment thereof, this embodiment can be modified at will, within the scope of the appended claims, without departing from the spirit and nature of the subject invention.

What is claimed is:

1. A sporting and exercising device comprising an upper foot-receiving portion, and a lower spring portion fastened to the foot-receiving portion and comprising (a) an upper spring layer arched upwardly and comprising first and second opposite ends, (b) a lower spring layer arched downwardly and comprising first and second opposite ends, (c) an intermediate, generally flat elongate member made of substantially elastic material and having first and second opposite ends, (d) a first connecting member for connecting the first end of the intermediate member to both the first ends of the upper and lower spring layers, and (e) a second connecting member for connecting the second end of the intermediate member to both the second ends of the upper and lower spring layers, the improvement therein comprising:

the intermediate member having first and second, longitudinally spaced apart openings each having a peripheral contour, a first needle made in the substantially elastic material and extending across the first opening from the peripheral contour of said first opening, and a second needle made in the substantially elastic material and extending across the second opening from the peripheral contour of said second opening;

a first resilient shock absorbing body having a first annular groove for receiving the peripheral contour of the first opening, a first hole which opens in the first annular groove for receiving the first needle, a first protuberance extending toward the upper spring layer, and a second protuberance extending toward the lower spring layer; and a second resilient shock absorbing body having a second annular groove for receiving the peripheral contour of the second opening, a second hole which opens in the second annular groove for receiving the second needle, a third protuberance extending toward the upper spring layer, and a fourth protuberance extending toward the lower spring layer.

2. A sporting and exercising device as recited in claim 1, in which the first needle extends from the peripheral contour of the first opening toward the first connecting member, and in which the second needle extends from the peripheral contour of the second opening toward the second connecting member.

3. A sporting and exercising device as recited in claim 1, in which the first needle, the second needle, the first hole and the second hole all have a rectangular cross section.

4. A sporting and exercising device as recited in claim 1, in which the first needle, the second needle, the first hole and the second hole all have a square cross section.

5. A sporting and exercising device as recited in claim 1, wherein:

the first and second openings are adjacent to the first and second ends of the intermediate members, respectively;

the first opening is generally rectangular with rounded corners, the peripheral contour of the first opening comprises one side opposite to the first connecting member, and the first needle extends from the center of said one side generally centrally of the first opening toward the first connecting member; and the second opening is generally rectangular with rounded comers, the peripheral contour of the second opening comprises one side opposite to the second connecting member, and the second needle extends from the center of said one side of the peripheral contour of the second opening generally centrally of said second opening toward the second connecting member.

6. A sporting and exercising device as recited in claim 1, wherein:

the first shock absorbing body comprises a first annular lip on one side of the first annular groove and a second annular lip on the other side of the first annular groove;

the intermediate member is recessed around the first opening on two faces of said intermediate member to receive the first and second lips, respectively;

the second shock absorbing body comprises a third annular lip on one side of the second annular groove and a fourth annular lip on the other side of the second annular groove; and the intermediate member is recessed on the two faces of said intermediate member around the second opening to receive the third and fourth lips, respectively.

7. A sporting and exercising device as recited in claim 1, wherein the intermediate member has a longitudinal axis and is lying in a first plane, wherein each protuberance of the first and second shock absorbing bodies has a trapezoidal cross section in a second generally perpendicular to the longitudinal axis of the intermediate member, and a second generally semielliptical cross section in a plane perpendicular to both the first and second planes.

8. A sporting and exercising device as recited in claim 1, wherein the intermediate member comprises a central section formed of separate, laterally adjacent strips which can be separately cut to adjust the resistance of the intermediate, generally flat and substantially elastic elongate member to tension in relation to the weight of a user of the sporting and exercising device.

9. A sporting and exercising device as recited in claim 8, in which the central section comprises three separate, laterally adjacent strips including two outer strips and a central strip interposed between the two outer strips.

10. A sporting and exercising device as recited in claim 9, wherein:

the intermediate, generally flat and substantially elastic elongate member comprises first and second longitudinal edge surfaces, a first portion between the first opening and the first longitudinal edge surface, a second portion between the first opening and the second longitudinal edge surface, a third portion between the second opening and the first longitudinal edge surface, and a fourth portion between the second opening and the second longitudinal edge surface; and a first one of the two outer strips is aligned with the first and third portions and the second one of the two outer strips is aligned with the second and fourth portions to prevent any concentration of stresses in the intermediate member around the first and second openings.

11. A sporting and exercising device as recited in claim 1, in which the intermediate member comprises a central section made of at least one helical spring.

12. A sporting and exercising device as recited in claim 11, wherein the intermediate member comprises two spaced apart tongues interconnected by the helical spring, and wherein at least one of the two spaced apart tongues comprises a set of longitudinally spaced apart holes for hooking one end of the helical spring whereby the tension in the helical spring can be changed by changing the hole of the set to which said one end of the helical spring is hooked.

13. A sporting and exercising device as recited in claim 1, in which the intermediate member comprises a central section made of a plurality of helical springs.

14. A sporting and exercising device as recited in claim 13, wherein the intermediate member comprises two spaced apart tongues interconnected by the helical springs, and wherein at least one of the two spaced apart tongues comprises a set of longitudinally spaced apart holes for hooking one end of each helical spring whereby the tension in the helical spring can be changed by changing the hole of the set to which said one end of the helical spring is hooked.

* * * * *

UNITED STATES PATENT AND TRADEMARK OFFICE

CERTIFICATE OF CORRECTION

PATENT NO. : 6,436,012 B1
DATED : August 20, 2002
INVENTOR(S) : Denis Naville

It is certified that error appears in the above-identified patent and that said Letters Patent is hereby corrected as shown below:

Title page,
Item [73], Assignee, delete "Christophe Ebersberg" and substitute -- Establishment Amra --

Signed and Sealed this

Third Day of June, 2003

JAMES E. ROGAN
*Director of the United States Patent and Trademark Office*